United States Patent [19]

Savins

[11] Patent Number: 4,496,012

[45] Date of Patent: Jan. 29, 1985

[54] METHOD FOR IMPROVING CUTTINGS TRANSPORT IN DEVIATED WELLS

[75] Inventor: Joseph G. Savins, Dallas, Tex.

[73] Assignee: Mobil Oil Corporation, New York, N.Y.

[21] Appl. No.: 490,914

[22] Filed: May 2, 1983

[51] Int. Cl.[3] ..... E21B 43/00

[52] U.S. Cl. ..... 175/65; 175/61

[58] Field of Search ..... 175/57, 61, 65, 70

[56] References Cited

U.S. PATENT DOCUMENTS

| | | | |
|---|---|---|---|
| 2,043,504 | 6/1936 | Blow | 175/70 |
| 2,252,669 | 8/1941 | Cross et al. | 175/70 |
| 3,040,821 | 6/1962 | Widess | 175/70 |
| 3,461,980 | 8/1969 | Kelley, Jr. | 175/70 |
| 4,289,631 | 9/1981 | Luxenburg | 175/57 |

OTHER PUBLICATIONS

"The Amatuer Scientist" by Jearl Walker.

*Primary Examiner*—Stephen J. Novosad
*Assistant Examiner*—William P. Neuder
*Attorney, Agent, or Firm*—A. J. McKillop; Michael G. Gilman; George W. Hager, Jr.

[57] ABSTRACT

An improved method of drilling a deviated well is effected by injecting a slug or series of slugs of a shear thickening fluid down the drill string ahead of the drilling fluid and into the annulus formed about the drill string to displace cuttings that accumulate in the annular regions where the drill string lies near the lower side of the deviated portion of the borehole thereby increasing cuttings transport efficiency. The shear thickening fluid has characteristics that enable it to dislodge and disperse the accumulated cuttings in that it undergoes a reversible, isothermal, increase in viscosity when subjected to an increasing shear rate. Slug volumes vary between 0.05 and 5 percent of the annulus volume between the drill string and the wellbore wall.

4 Claims, No Drawings

METHOD FOR IMPROVING CUTTINGS TRANSPORT IN DEVIATED WELLS

BACKGROUND OF THE INVENTION

This invention relates to an improved method of drilling a deviated well wherein a slug of a shear thickening fluid is periodically injected into the drill string ahead of the drilling fluid to increase cuttings transport efficiency.

In the drilling of wells into the earth by rotary drilling techniques, a drill bit is attached to a drill string, lowered into a well, and rotated in contact with the earth; thereby breaking and fracturing the earth and forming a wellbore thereinto. A drilling fluid is circulated down the drill string and through nozzles provided in the drill bit to the bottom of the wellbore and thence upward through the annular space formed between the drill string and the wall of the wellbore. The drilling fluid serves many purposes including cooling the bit, supplying hydrostatic pressure upon the formations penetrated by the wellbore to prevent fluids existing under pressure therein from flowing into the wellbore, reducing torque and drag between the drill string and the wellbore, maintaining the stability of open hole (uncased) intervals, and sealing pores and openings penetrated by the bit. A most important function is hole cleaning (carrying capacity), i.e. the removal of drill solids (cuttings) beneath the bit, and the transport of this material to the surface through the wellbore annulus.

A measure of the efficiency of the hole cleaning operation is the difference between the annular fluid velocity ($V_A$) and the terminal (slip) velocity ($V_S$) at which the largest cutting settles divided by the annular fluid velocity. The equation for determining transport ratio (TR) is $$TR = \left(\frac{V_A - V_S}{V_A}\right) \times 100$$

where $V_A$=annular fluid velocity $V_S$=terminal (slip) velocity.

Obviously total removal of drill solids would correspond to a transport ratio of 100 percent, however, this degree of efficiency can be difficult to achieve because of practical constraints on the factors enumerated above. Thus in practice it is customary to set some minimum value to this transport ratio based on experience in drilling operations in a certain area, or to relate the ratio to the maximum concentration of drill solids to be permitted in the annulus between the drill string and the wellbore wall.

Reduced bit life, slow penetration rate, bottom hole fill up during trips, stuck pipe, lost circulation, can result when drill solids are inefficiently removed in the drilling of vertical boreholes. The efficiency of cuttings removal and transport becomes even more critical in drilling the deviated or inclined wellbore, particularly when the inclination is between 15 and 50 degrees, because as cuttings settle along the lower side of the wellbore, this accumulation results in the formation of a cutting bed. As a result of the reduction in net area open to flow, cuttings transport becomes severely impaired. If the drill pipe lies on the low side of an open hole interval (positive eccentricity), drill solids concentrate in the constricted space and conditions susceptable to differential sticking of the pipe can also occur. Hole cleaning can also be a problem under conditions where the drill string is in tension and intervals of negative eccentricity result as the drill string is pulled to the high side of the annulus. In the latter situation, the drill string is not usually in direct contact with the cuttings bed, but the latter's presence can lead to incidents of stuck pipe when circulation is stopped to pull out of the hole.

Various methods have been proposed for improving the efficiency of cuttings removal from the wellbore, including, promoting the formation of a particular flow regime throughout the annulus, altering the rheology of the entire drilling fuid volume, increasing the annular velocity, rotating pipe, and combinations thereof. In the case of the inclined wellbore, Dellinger's U.S. Pat. No. 4,246,975 teaches the use of eccentric tool joints to stir up the cuttings bed, thus aiding in its removal.

The present invention provides an improved method for drilling a deviated well wherein cuttings that become lodged and accumulate in the annular region where the drill string lies near the lower side of the deviated portion of the borehole (positive eccentricity) are displaced by injecting a slug or a series or slugs of a fluid which undergoes a reversible, isothermal, increase in viscosity when subjected to an increasing shear rate. To those skilled in the art, this category of rheologically complex flow behavior is referred to as shear thickening, a comprehensive discussion of which may be found in the literature including, for example, Savins, J. G., ENCYCLOPEDIA OF INDUSTRIAL CHEMICAL ANALYSIS, Vol. 3, 1966, John Wiley and Sons, Inc. The locally increased viscous resistance increases the local shear stress to shear, erode, and dislodge the cuttings bed, thereby improving cuttings transport efficiency.

SUMMARY OF THE INVENTION

This invention is directed to a method for increasing the cuttings transport efficiency during the drilling of a deviated well in the earth, said well being drilled employing a drill string and a drilling fluid system wherein a drilling fluid is circulated down the drill string and upwardly through the annular space between the drill string and the borehole wall comprising injecting a slug of a shear thickening fluid down the drilling string ahead of said drilling fluid that displaces cuttings that accumulate in the annular region where the drill string lies in the vicinity of the lower side of the well. Injection of the slug of shear thickening fluid may be periodically repeated. The shear thickening fluid may comprise water, oil, or an emulsion of oil and water as the continuous phase, together with water or oil soluble polymer-complexing reagents, mixtures of petroleum sulfonates, alcohols, and electrolytes, or mixtures of petroleum sulfonates and water soluble polymers which undergo a reversible, isothermal, increase in viscosity when subjected to an increasing shear rate. The slug volume of the shear thickening fluid is within the range of 0.05 to 5 percent of the annulus volume between the drill string and the wellbore wall.

DESCRIPTION OF THE PREFERRED EMBODIMENTS

The present invention is directed to an improved method for drilling a deviated well and more particularly to injecting a slug of a shear thickening fluid ahead of the drilling fluid to improve cuttings transport efficiency.

In the completion of a deviated well by the rotary method wherein the wellbore is drilled to first extend downwardly from the earth's surface and then extend a substantial distance through the formation in a generally horizontal direction, the cuttings transport efficiency becomes even more critical because the drilling string is generally constrained to lie in the vicinity of the low side of the hole, thereby resulting in cuttings concentrating in the constricted flow channel beneath the drilling string and the wall of the well.

In accordance with this invention a slug or series of slugs of a shear thickening fluid is injected down the drill string ahead of the drilling fluid during the drilling operation and into the annulus formed between the drill string and the wall of the well that displaces accumulated cuttings in the annular region where the drilling string lies in the vicinity of the lower side of the well thereby increasing the cuttings transport efficiency. The shear thickening fluid has characteristic that enable it to dislodge and disperse the accumulated cuttings in the annulus located on the lower side of the drill string by an eroding/scouring action which results from the development of the high structural viscosity when subjected to an increasing shear rate, or the formation of a certain flow regime, or combinations thereof. These characteristics may be imparted a variety of ways. The reactants which give rise to shear thickening action can be homogenously dispersed throughout a slug. The reactants may be combined in such a way for these desirable characteristics to occur in the interface between the displaced bed of cuttings and displacing slug. Alternately, these characteristics may be gradual over a series of injected slugs, each representing a fracture of the total annular volume, or tapered over a longer fractional annular volume.

The slug or slugs of the shear thickening fluid can be injected as a liquid, colloidal dispersion, emulsion, slurry, foam, or combination thereof. The slug may be injected and passed immediately through the annulus, or circulation stopped and the slug spotted for a period of time, and circulation resumed. A perferred form of injection is through the drill string and upwardly through the annulus formed about the drill string. In another embodiment, reverse circulation of the slug may be employed if the design of the bottom hole assembly permits.

In accordance with another embodiment of this invention, it may be desirable to match the density of the shear thickening fluid with conditions which will enhance the lift of the dislodged cuttings.

Suitable shear thickening systems include a water soluble polymer-complexing reagent, or a mixture of water, petroleum sulfonates/alcohols/electrolytes, such as are described in my U.S. Pat. Nos. 3,299,952 and 4,042,030, respectively. Mixtures of petroleum sulfonates and water soluble polymers described by Ahearn in French Patent No. 1,539,568 constitute suitable shear thickeners, as do the shear thickening compositions and placement techniques described in Great Britain Pat. Nos. 2,071,150A and 2,075,087A. All of these disclosures are hereby incorporated by reference. In addition, the external phase of the shear thickening fluid may be an oil for applications involving an oil based drilling fluid in which case an oil soluble polymer-complexing reagent is used.

The slug volume of shear thickening fluid used in carrying out this invention will normally vary between 0.05 and 5 percent of the annulus volume between the drill string and the wellbore wall.

It is not the intent of this invention to teach a method for continuous removal of cuttings. Rather this method of batch hole cleaning is practiced at times dictated by local observations of the depth of operations and local conditions. In some instances, it may only be necessary to inject a slug or slugs once every 24 to 48 hours (or even longer), whereas under other circumstances it may be desirable to repeat the practice of this method of hole cleaning over much shorter time intervals. Preferably the slug of shear thickening fluid is injected when the cuttings transport efficiency of the drilling fluid just begins to deteriorate. Cuttings transport efficiency can be determined by measuring the volume of cuttings discharged from the well with drilling fluid during the drilling operation, although this technique suffers from delayed response due to the time required for the cuttings to travel up the annulus. A method with real time capabilities involves the calculation of effective friction factors from measured hook loads.

Although the present invention has been described with preferred embodiments, it is to be understood that modifications and variations may be resorted to, without departing from the spirit and scope of this invention, as those skilled in the art will readily understand. Such variations and modifications are considered to be within the purview and scope of the appended claims.

What is claimed is:

1. A method for increasing the cuttings transport efficiency during the drilling of a deviated well in the earth, comprising the steps of:

(a) circulating a drilling fluid through said deviated well having a viscosity sufficient to transport non-entrapped cuttings up the annulus of said deviated well between the drill string and the borehole wall to the earth's surface, and (b) periodically terminating the circulation of said drilling fluid and injecting a slug of a shear thickening fluid which is spotted for a predetermined time period, and (c) resuming the circulation of said drilling fluid after said predetermined time period whereby said injected slug of thickening fluid will undergo a locally increased viscosity change during circulation due to an increased shear stress along the length of the face of any cuttings bed that may have formed in that part of said annulus where the drill string lies along the lower side of the borehole wall, whereby said cuttings bed is dislodged, the lower injection viscosity of said slug of fluid being sufficient to transport the dislodged cuttings up the remaining portion of said annulus to the earth's surface.

2. The method of claim 1 wherein the volume of said slug of shear thickening fluid is within the range of 0.05 to 5 percent of the annulus volume between the drill string and the wellbore wall.

3. The method of claim 1 further including the step of after the slug of shear thickening fluid has advanced a predetermined distance upwardly through said annulus between the drill string and the borehole wall, thereafter reversing the circulation of drilling fluid by passing the drilling fluid downwardly into said annular space and upwardly through the drill string.

4. The method of claim 1 wherein the density of the shear thickening fluid is controlled to enhance displacement of accumulated cuttings from said annular space.

* * * * *